United States Patent [19]

Gernert

[11] 4,126,463

[45] Nov. 21, 1978

[54] METHOD OF STABILIZING PHOTOGRAPHIC SILVER HALIDE EMULSION LAYERS

[75] Inventor: Herbert Gernert, Munich, Germany

[73] Assignee: Agfa-Gevaert Aktiengesellschaft, Leverkusen, Germany

[21] Appl. No.: 831,592

[22] Filed: Sep. 8, 1977

[30] Foreign Application Priority Data

Sep. 14, 1976 [DE] Fed. Rep. of Germany ..... 2641284

[51] Int. Cl.[2] ..... G03C 1/76; G03C 1/48; G03C 1/30

[52] U.S. Cl. ..... 96/67; 96/76 R; 96/95; 96/110

[58] Field of Search ..... 96/67, 76 R, 109, 110, 96/95, 107

[56] References Cited

U.S. PATENT DOCUMENTS

| | | | |
|---|---|---|---|
| 2,440,206 | 4/1948 | Mueller | 96/109 |
| 3,008,829 | 11/1961 | Clementi et al. | 96/109 |
| 3,161,520 | 12/1964 | Rauch et al. | 96/109 |
| 3,598,598 | 8/1971 | Herz | 96/109 |
| 3,672,903 | 6/1972 | Chang | 96/110 |
| 3,679,423 | 7/1972 | Pollet et al. | 96/109 |
| 3,707,376 | 12/1972 | Stappen et al. | 96/109 |
| 3,915,713 | 10/1975 | Shiba et al. | 96/109 |
| 3,929,486 | 12/1975 | Habu et al. | 96/109 |

FOREIGN PATENT DOCUMENTS

| | | | |
|---|---|---|---|
| 1,285,313 | 12/1968 | Fed. Rep. of Germany | 96/100 |

*Primary Examiner*—Won H. Louie, Jr.
*Attorney, Agent, or Firm*—Connolly and Hutz

[57] ABSTRACT

In a method of stabilizing photographic silver halide emulsion layers containing polyalkylene oxide compounds a protective gelatine layer is applied to the emulsion layer which contains from 0,35 to 35 mg of a water soluble thiosulphate.

3 Claims, No Drawings

METHOD OF STABILIZING PHOTOGRAPHIC SILVER HALIDE EMULSION LAYERS

This invention relates to a method of reducing the fog produced, during storage, in photographic materials which have been sensitized by the addition of development accelerators such as polyoxyalkylene compounds.

Photographic silver halide layers to which polyoxyalkylene compounds have been added undergo progessive fogging during storage at normal room temperature and moisture as well as under extreme climatic conditions. The severity of this fogging depends on the nature of the emulsion, the pH and pAg values to which the emulsion has been adjusted and the presence of suitable antifogging agents and stabilizers. Compounds such as triazaindolazines or compounds which form sparingly soluble silver salts, such as mercapto or disulphide compounds, are particularly effective in reducing fogging. It is also known to use inorganic and organic noble metal salts or very small quantities of mercy compounds for stabilizing photographic material. These substances produce no significant reduction in fogging when added to silver halide emulsion layer which have been sensitized with polyoxyalkylene compounds and, even when they are added in optimum quantities, they cause undesirable side effects such as loss of gradation and desensitization.

In silver halide emulsions which have been sensitized with polyoxyalkylene compounds, the increase in fogging which occurs during storage is only slightly reduced by the known stabilizing additives. Although the increase in fogging can to a large extent be prevented by using larger doses of stabilizer, this would destroy most of the sensitizing effect of the polyoxyalkylene compound.

It is therefore an object of the present invention to reduce as far as possible the increase in fogging and loss of gradation which occurs, during storage, in silver halide emulsions which have been optimally ripened and sensitized with polyoxyalkylene compounds.

This problem is reduced or substantially solved by a method of stabilizing photographic silver halide emulsion layers containing gelatine and polyalkylene oxide compounds against the increase in fogging and loss of gradation during storage, in which a protective gelatine layer containing from 20 to 2000mg of a water-soluble thiosulphate per 100 g of gelatine is applied to the silver halide emulsion layer so that the protective layer contains from 0.35 to 35 mg of thiosulphate per $m^2$, and the layers are then dried.

The addition of water-soluble thiosulphates to the protective layer has the advantage that the action of the thiosulphate on the silver halide emulsion is limited to a very short time during solidification and drying of the silver halide emulsion layer so that no adverse side effect is produced when the silver halide emulsion is left to stand.

Alkali metal thiosulphates are commonly added to a silver halide emulsion during after-ripening to increase the sensitivity and produce a steeper gradation. However, even if optimum operation conditions are observed, an increase in fogging due to subsequent digestion with thiosulphate cannot be completely prevented. A method of adding thiosulphate to a silver halide emulsion containing colour coupler after the after-ripening stage in order to stabilize it against the loss in sensitivity and maximum density during storage without altering the basic fog has be described in German Auslegeschrift No. 1,285,313. It was therefore surprising to find that in silver halide emulsions which have been sensitized with polyoxyalkylene compounds and do not contain colour couplers, a considerable reduction in the fog produced during storage of the material could be obtained by adding thiosulphate specifically to the protective layer.

Soluble thiosulphates suitable for the process of the invention include in particular the known alkali metal thiosulphates as well as alkaline earth metal thiosulphates and the complex salts of soluble thiosulphates with gold.

The polyoxyalkylene compounds used in slver halide emulsions include polyoxyethylene oxides with molecular weights from 1000 to 20.000, polyalkylene glycols such as polyethylene glycol or polypropylene glycol, fatty acid esters, fatty alcohol ethers and compounds such as polyoxyethylene stearates with molecular weights between 1000 and 20.000 as well as copolymers of the above mentioned polymers. The polyoxyalkylene compound preferably has an average molecular weight above 1000.

It is advantageous to use azaindolizines in addition to the thiosulphate compounds for stabilizing the sensitivity, although other known stabilizers may also be added to the emulsion, such as triazoles, mercapto compounds, inorganic or organic mercury compounds and palladium salts. The silver halide emulsions may also contain optical sensitizers and the usual casting additives such as plasticizers, wetting agents, antistatic agents or other special additives required for the particular purpose for which the emulsion is to be used. The protective layer preferably has a thickness of from 0.3 to 2$\mu$.

Silver halide emulsions which are stabilized according to the invention may be after-ripened to optimum sensitivity with sulphur compounds or with gold and sulphur compounds or with other heavy metal salts.

The invention is explained in more detail with the aid of the following examples. FIGS. given in percentages refer to percentages by weight unless otherwise indicated.

EXAMPLE 1

530 mg of triazaindolizine per mol of silver halide were added after complete after-ripening to a silver iodobromide emulsion of medium sensitivity which had an iodide content of 2.5 mol % and had been sensitized with gold and thiosulphate. To this emulsion, which had been adjusted to a silver content of 170 g of silver nitrate per liter and a gelatine content of 15%, were added, per kg of emulsion, 20 ml of 5% saponin solution and 200 ml of a 20% aqueous polyethylacrylate dispersion as plasticizer and 85 mg of a polyethylene oxide with an average molecular weight of 10,000 as development accelerator. Formalin was used as hardener which was added to the emulsion in a quantity of 30 ml of a 2% solution per 150 g of gelatine shortly before the emulsion was cast.

The protective layer contained 5% of a gelatine suitable for this purpose, 40% saponin solution, 40 ml of a 5% saccharose monolaurate solution and 20 ml of a 5% chromium acetate solution. This protective layer was divided into six equal parts and to each part were added 0, 30, 60, 120, 240 or 480 mg, respectively, of $Na_2S_2O_3.5H_2O$ per liter of protective layer composition.

When the emsulion was ready for casting, it was cast in six strips on a polyester substrate backed with antihalation layer, the emulsion being cast to form layers 9μ in thickness containing 9 g of silver nitrate per $m^2$. The six different protective layers were applied to the emulsion in a thickness of 1.4μ and the film was dried.

Sensitometer strips of fresh film and of film which had been stored at 60° C. for 72 hours were exposed for 1/20 second in a rapid exposure sensitometer and developed in a roller train developing machine, using a phenidone hydroquinone developer. The developer contained 8 g of hydroquinone and 0.3 g of phenidone per liter and 3.4 g of potassium bromide per liter and was adjusted to pH 9.7. The develoment time was 2 minutes 30 seconds at 26° C. Table 1 shows the fog values, sensitivities, gradations and maximum densities of freshly prepared samples and samples which had been stored in the heating cupboard.

The series of experiments shows that when 30 mg or more of $Na_2S_2O_3.5\ H_2O$ are added per liter of protective layer, a considerable reduction in the fog produced by storage in a heating cupboard is achieved in silver halide emulsions which have been sensitized with polyoxyalkylene compounds.

EXAMPLE 2

85 mg of polyethylene oxide having an average molecular weight of 1000, 4000, 10,000 and 20,000, respectively, were added to the silver halide emulsion from Example 1. To one strip of each emulsion layer was applied a protective layer free from thiosulphate and to another strip thereof was applied the same protective layer containing 120 mg of $Na_2S_2O_3.5H_2O$ per liter. The samples were exposed, developed and examined as described in Example 1. The results of sensitometric examination are summarised in Table 2.

This series of experiments also demonstrates the fog reducing and stabilizing effect of the addition of thiosulphates to the protective layer when silver halide emulsions which have been sensitized with polyethylene oxide are stored in the heating cupboard.

EXAMPLE 3

Polyethylene oxide 10.000 was added in double quantity and in four times the quantity to a silver halide emulsion according to Example 1 and the emulsion layers were covered with two different protective layers, one with and one without thiosulphate. The samples were then assessed as before. The results of sensitometric examination are summarized in Table 3.

The stabilizing effect of the addition of thiosulphate to the protective layer is obtained even when a very much larger quantity of polyethylene oxide is added to the silver halide emulsion.

EXAMPLE 4

Copolymers of 60% polypropylene glycol and 40% of polyethylene glycols having an average molecular weight of approximately 300 and 8300 and in addition a polyoxyethylene stearate, molecular weight approximately 1700, and a polyoxyethylene stearate molecular weight approximately 4500, were added to samples of a silver halide emulsion according to Example 1. To each portion of the emulsion 250 mg of the polymer per kg of emulsion were added. The emulsion layers were covered with two different protective layers, with and without the addition of thiosulphate. The results of sensitometric examination are summarized in Table 4.

The stabilizing effect of the thiosulphate obtained when copolymers and polyoxyethylene derivatives are used is as good as that obtained with pure polyethylene oxide.

EXAMPLE 5

The silver iodobromide emulsion from Example 1 was sensitized to the green spectral region and 1-(2,4,6-trichlorophenyl)-3-heptadecyl-5-pyrazolone was added as magenta coupler.

The emulsion was used to prepare samples which differed in the composition of their protective layer as described in Example 1. The samples were developed for 4 minutes at 22° C. while kept in vigorous motion. The results are summarized in Table 5. They are not found to be significantly different from the results obtained in Example 1, in that the fog values after storage are not found to be reduced Table 1

| mg $Na_2S_2O_3 . 5\ H_2O/l$ Composition of protective layer | Properties of fresh sample | | | Properties after 72 hours' storage at 60° C | | |
|---|---|---|---|---|---|---|
| | Fog | Sensitivity log It | Gradient 0.30/1.70 | Fog | Sensitivity log It | Gradient 0.30/1.70 |
| 0 | 0.06 | 2.43 | 1.76 | 0.54 | — | — |
| 30 | 0.05 | 2.34 | 1.77 | 0.25 | 2.95 | 1.09 |
| 60 | 0.04 | 2.33 | 1.76 | 0.12 | 2.60 | 1.46 |
| 120 | 0.04 | 2.30 | 1.75 | 0.09 | 2.50 | 1.53 |
| 240 | 0.04 | 2.26 | 1.75 | 0.08 | 2.45 | 1.55 |
| 480 | 0.04 | 2.26 | 1.75 | 0.09 | 2.45 | 1.50 |

Table 2

| mg of polyethylene oxide/kg of emulsion | Mg $Na_2S_2O_3 . 5H_2O/l$ Composition of protective layer | Properties of fresh sample | | | Properties after 72 hours' storage at 60° C | | |
|---|---|---|---|---|---|---|---|
| | | Fog | Sensitivity log It | Gradient 0.30/1.70 | Fog | Sensitivity log It | Gradient 0.30/1.70 |
| 85 mg PEO* 1000 | — | 0.05 | 2.32 | 1.71 | 0.13 | 2.54 | 1.36 |
| " | 120 mg | 0.05 | 2.24 | 1.76 | 0.08 | 2.48 | 1.43 |
| 85 mg PEO 4000 | — | 0.05 | 2.40 | 1.69 | 0.40 | — | — |
| " | 120 mg | 0.04 | 2.26 | 1.75 | 0.08 | 2.43 | 1.50 |
| 85 mg PEO 10 000 | — | 0.05 | 2.40 | 1.70 | 1.63 | — | — |
| " | 120 mg | 0.04 | 2.30 | 1.75 | 0.08 | 2.45 | 1.50 |
| 85 mg PEO 20 000 | — | 0.05 | 2.40 | 1.70 | 0.78 | — | — |
| " | 120 mg | 0.04 | 2.31 | 1.79 | 0.08 | 2.47 | 1.55 |

*PEO = polyethylene oxide

Table 3

| mg of PE 10 000/kg of emulsion | mg of $Na_2S_2O_3 \cdot 5H_2O$/l Composition of protective layer | Properties of fresh sample | | | Properties after 72 hours' storage at 60 ° C | | |
|---|---|---|---|---|---|---|---|
| | | Fog | Sensitivity log It | Gradient 0.30/1.70 | Fog | Sensitivity log It | Gradient 0.30/1.70 |
| 170 | — | 0.05 | 2.59 | 1.72 | 1.92 | — | — |
| 170 | 120 | 0.05 | 2.50 | 1.64 | 0.10 | 2.70 | 1.46 |
| 340 | — | 0.06 | 2.65 | 1.85 | 2.05 | — | — |
| 340 | 120 | 0.06 | 2.55 | 1.92 | 0.16 | 3.09 | 1.42 |

Table 4

| | mg/kg of emulsion | mg of $Na_2S_2O_3 \cdot 5H_2O$/l Composition of protective layer | Fresh sample Fog | 72 hours' storage at 60° C Fog |
|---|---|---|---|---|
| Copolymer of 60% of polypropylene glycol and 40% of polyethylene glycol, MW ~ 3000 | 250 | 120 | 0.04 | 0.07 |
| Copolymer of 20% of polypropylene glycol and 80% of polyethylene glycol, MW ~ 8300 | 250 | — | 0.04 | 1.45 |
| | 250 | 120 | 0.04 | 0.09 |
| Polyoxyethylene-33 stearate MW ~ 1700 | 250 | — | 0.04 | 0.49 |
| | 250 | 120 | 0.04 | 0.13 |
| Polyoxyethytlene-95 stearate MW ~ 4500 | 250 | — | 0.04 | 0.84 |
| | 250 | 120 | 0.04 | 0.17 |

Table 5

| mg $Na_2S_2O_3 \cdot 5\ H_2O$/l Composition of protective layer | Properties of fresh sample | | | Properties after 72 hours storage at 60° C | | |
|---|---|---|---|---|---|---|
| | Fog | Sensitivity log It | Gradient 0.30/1.70 | Fog | Sensitivity log It | Gradient 0.30/1.70 |
| 0 | 0.06 | 2.61 | 2.26 | 0.68 | — | — |
| 30 | 0.05 | 2.51 | 2.18 | 0.52 | — | — |
| 60 | 0.05 | 2.53 | 2.29 | 0.63 | — | — |
| 120 | 0.05 | 2.55 | 2.30 | 0.75 | — | — |
| 240 | 0.05 | 2.52 | 2.30 | 0.88 | — | — |
| 480 | 0.05 | 2.50 | 2.37 | 0.94 | — | — |

I claim:

1. Method of stabilizing photographic gelatine-silver halide emulsion layers containing polyoxyalkylene compounds against increase in fogging and loss in gradation during storage, characterised in that from 0.35 to 35 mg of thiosulfate per $m^2$ is applied to the silver halide emulsion layer containing a polyoxyalkylene compound by superimposing over said silver halide emulsion layer a protective layer of gelatin and a stabilizer consisting of a water-soluble thiosulfate in an amount of from 20 to 2000 mg of the water-soluble thiosulphate per 100 g of gelatin, and then drying the layers.

2. Process according to claim 1, characterised in that the polyoxyalkylene compounds used have an average molecular weight greater than 1000.

3. Process according to claim 1, characterised in that the thickness of the protective layer is from 0.3 to 2μ.

* * * * *

UNITED STATES PATENT AND TRADEMARK OFFICE

CERTIFICATE OF CORRECTION

PATENT NO. : 4,126,463

DATED : November 21, 1978

INVENTOR(S) : HERBERT GERNERT

It is certified that error appears in the above-identified patent and that said Letters Patent are hereby corrected as shown below:

Column 2, line 61, cancel "40% saponin" and insert

-- 40 ml of a 5% saponin --

Columns 5 and 6, Table 4, under "mg/kg of emulsion" insert

-- 250 --; under "mg of $Na_2S_2O_3.5H_2O$/l Composition of Protective layer" insert -- - --;

under " Fresh sample Fog" insert -- 0.04 --; and under "72 hours' storage at 60°C Fog" insert -- 0.37 --.

Column 4, line 38, delete "not".

Signed and Sealed this

*Eleventh* Day of *September 1979*

[SEAL]

*Attest:*

*Attesting Officer*

LUTRELLE F. PARKER

*Acting Commissioner of Patents and Trademarks*